United States Patent [19]

Lang et al.

[11] Patent Number: 4,628,799

[45] Date of Patent: Dec. 16, 1986

[54] DUCT ATTACHMENT AND EXTENSION FOR AN AIR CONDITIONING UNIT

[75] Inventors: Richard D. Lang, Chittenango; Floyd J. Frenia, Liverpool, both of N.Y.

[73] Assignee: Carrier Corporation, Syracuse, N.Y.

[21] Appl. No.: 720,765

[22] Filed: Apr. 8, 1985

[51] Int. Cl.[4] ..... F24F 13/02

[52] U.S. Cl. ..... 98/40.19; 285/194; 285/424

[58] Field of Search ..... 98/40.19, 39.1, 40.01, 98/40.28, 40.18, 41.1, 102, 103, 108, 106, 114, 67; 62/262; 285/194, 195, 424; 248/65

[56] References Cited

U.S. PATENT DOCUMENTS 571,297 11/1896 Bossert ..... 285/194 X 1,178,050 4/1916 Bent ..... 98/67

4,020,753 5/1977 Efstratis ..... 98/40.19

4,315,457 2/1982 Lang et al. ..... 98/40.19

*Primary Examiner*—Harold Joyce

*Attorney, Agent, or Firm*—Robert H. Kelly

[57] ABSTRACT

A duct adapter for use in conjunction with an air conditioning unit is disclosed. This adapter attached to a discharge opening of a Packaged Terminal Air Conditioning unit and acts to divide the stream of conditioned air into multiple streams, one being discharged into the enclosure containing the air conditioning unit and a separate stream being discharged into an extension duct for delivery at a distant location. The extension duct is attached to a bracket fixed to the side of a through-the-wall sleeve, while the end of the extension in a slidable engagement so that the unit may slide out of the sleeve while the extension remains fixed to the sleeve.

6 Claims, 3 Drawing Figures

DUCT ATTACHMENT AND EXTENSION FOR AN AIR CONDITIONING UNIT

BACKGROUND OF THE INVENTION

This invention relates generally to duct attachment means for use with an air conditioning unit and, more particularly, to a duct adapter which fits directly over the discharge outlet of a packaged terminal air conditioning unit and a duct extension which attaches to the duct adapter such that air being discharged from the unit may be divided into separate air streams for discharge to adjacent rooms.

Although the present invention can be used in association with a wide range of air conditioning units, it is particularly well suited for use in conjunction with a packaged terminal air conditioning unit (PTAC). PTAC units are generally low profile inside units that slide into a sleeve which passes through an outside facing wall of a building. This type of unit, because of its ease of installation and operational flexibility, has found a wide range of applications in many types of buildings such as office buildings, apartment houses, dormitories, and motels. These units normally have an evaporator section in communication with the room air for conditioning said air as it is drawn through the unit, and a condensing section located in communication with ambient air for discharging heat energy thereto.

Often, it is desirable to condition the air in more than one room utilizing a single packaged terminal air conditioning unit. To accomplish this, a duct adapter is attached directly over the discharge outlet of the PTAC unit. This adapter has a plenum assembly for receiving conditioned air from the unit and discharging the conditioned air through multiple discharge openings. A lateral duct extension attaches to one of the discharge openings and directs a portion of the discharge air to an adjoining room, either to the right or to the left of the unit.

In prior PTAC units, the duct adapter was removably secured to the unit while the duct extension had one end thereof inserted through one of the discharge outlets of the adapter and the other end fixedly mounted to the wall of the room to discharge air to an adjoining room. Accordingly, whenever the chassis had to be removed from the wall sleeve, e.g. for repair, the entire duct adapter and duct extension had to first be removed from the unit and the wall before the chassis could be slid out of the sleeve for repair.

SUMMARY OF THE INVENTION

It is an object of the present invention to provide a duct attachment means to an air conditioning unit for converting a single stream of discharge air into multiple streams for conditioning adjoining rooms.

It is another object of the present invention to provide a duct adapter assembly capable of being easily attached to a duct extension fixedly attached to the wall of a room for directing discharge air to an adjoining room.

It is a further object of the present invention to provide a duct adapter for a packaged terminal air conditioning unit which can remain attached to the chassis of the unit while the chassis is removed for repairs and at the same time have the duct extension remain fixed to the wall of the room.

These and other objects of the present invention are attained by means of a duct adapter assembly for a PTAC unit having a discharge plenum assembly designed to be connected to the unit at a discharge opening. The adapter has a plurality of walls, some of which are adapted to coact with structural portions of the PTAC unit to secure the adapter thereto. The adapter additionally has a front wall defining grille support surfaces wherein an adjustable discharge grille may be inserted to regulate the discharge of air therefrom. The adapter has at least one side wall having flange means circumscribing a portion of a duct opening therein such that a duct extension may be connected to the flange means to receive a portion of the air flowing into the adapter. A bracket having a flange extending outwardly from one side thereof is provided to be connected to the wall sleeve of the unit in such a manner that the duct extension may be attached to the flange extending from the bracket.

The various features of novelty which characterize the invention are pointed out with particularity in the claims annexed to and forming a part of this specification. For a better understanding of the invention, its operating advantages and specific objects attained by its use, reference should be had to the accompanying drawings and descriptive matter in which there is illustrated and described a preferred embodiment of the invention.

BRIEF DESCRIPTION OF THE DRAWINGS

In the accompanying drawings, forming a part of this specification, and in which reference numerals shown in the drawings designate like or corresponding parts throughout the same.

DESCRIPTION OF THE PREFERRED EMBODIMENT

Figure 1:
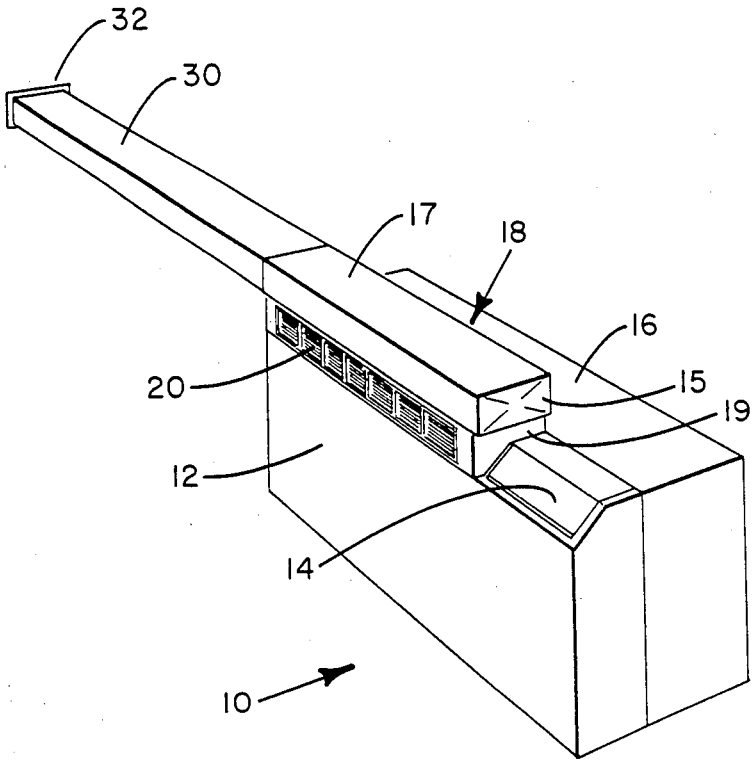
FIG. 1 is an isometric view of a packaged terminal air conditioning unit including a duct adapter and a lateral duct extension.

Referring now to the drawings and, in particular, to FIG. 1, there is shown a packaged terminal air conditioning unit 10 having a discharge plenum assembly or duct adapter 18 and a duct extension 30 for supplying conditioned air to adjacent enclosures. The air conditioning unit 10 is shown having a front cover 12, a through the wall sleeve 16, and a control door 14. The control door is mounted to cover the controls for regulating the operation of the unit.

In the present invention, the duct adapter 18 is inserted into the air discharge opening (not shown) of the unit when it is desired to provide conditioned air to more than one enclosure from a single unit. The duct adapter 18 is mounted to the unit by way of a lower housing member 19. The lower housing member 19 has an upper housing member 17 attached to the front and rear thereof, and a discharge grille 20 mounted at the front of the duct adapter such that a portion of the air discharged from unit 10 is discharged through grille 20. The duct extension 30 has one end engaging an end of duct adapter 18 and has an air register 32 secured at the opposite end of the duct extension for discharging conditioned air into the adjacent enclosure. The duct adapter has an end plug 15 secured to the end opposite the end having the duct extension 30 attached thereto. When assembled, the duct adapter and duct extension will normally discharge conditioned air into an adjoining room through air register 32 and into the room containing the unit through discharge grille 20. It should be understood however, that by removing the duct extension 30 and the end plug 15, and reversing their positions relative to the duct adapter, air may be discharged to an adjoining room either to the right or left of the unit.

Figure 2:
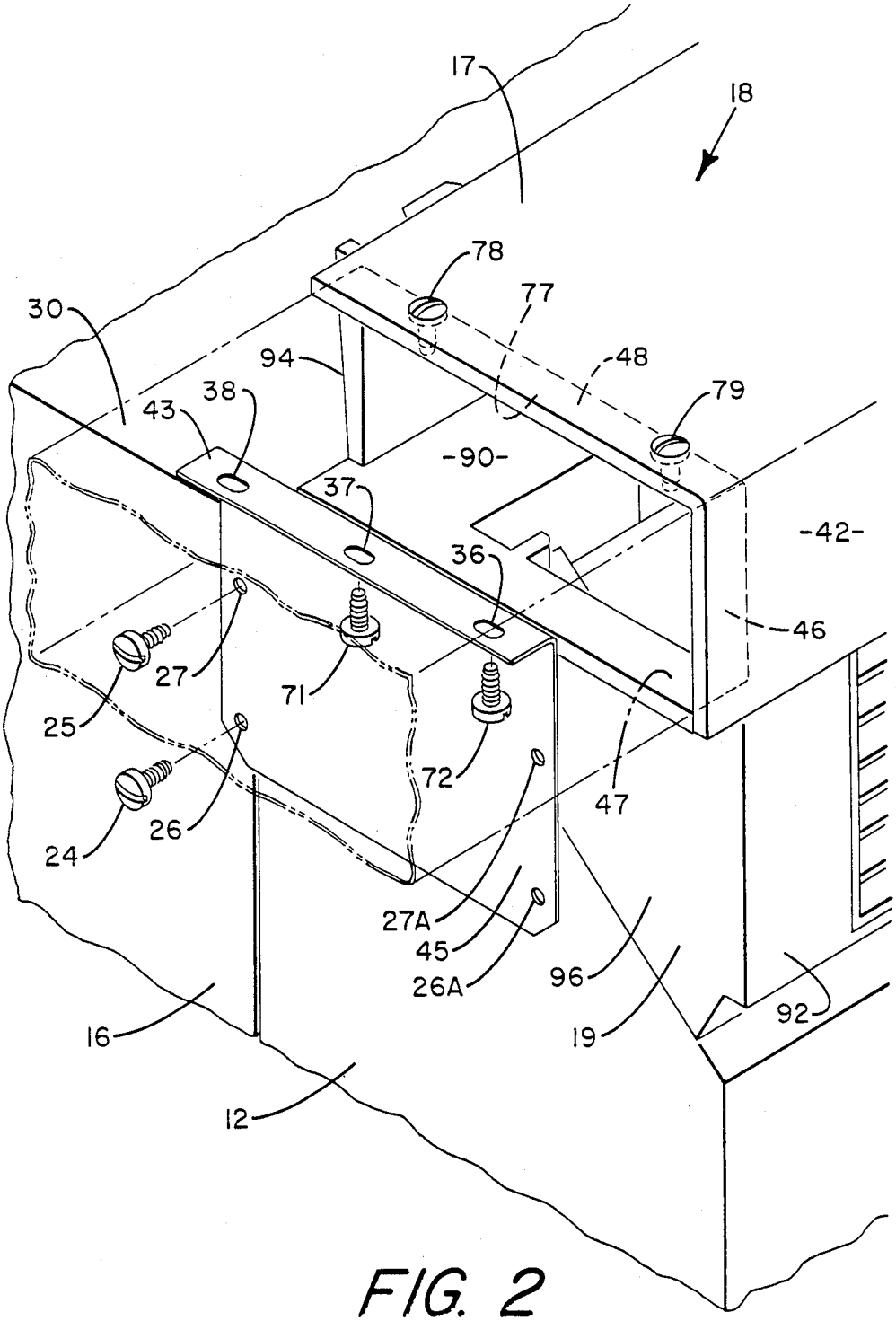
FIG. 2 is an isometric view of an exploded partially cut away section of a packaged terminal air conditioning unit including the duct adapter assembly of the present invention.
Figure 3:
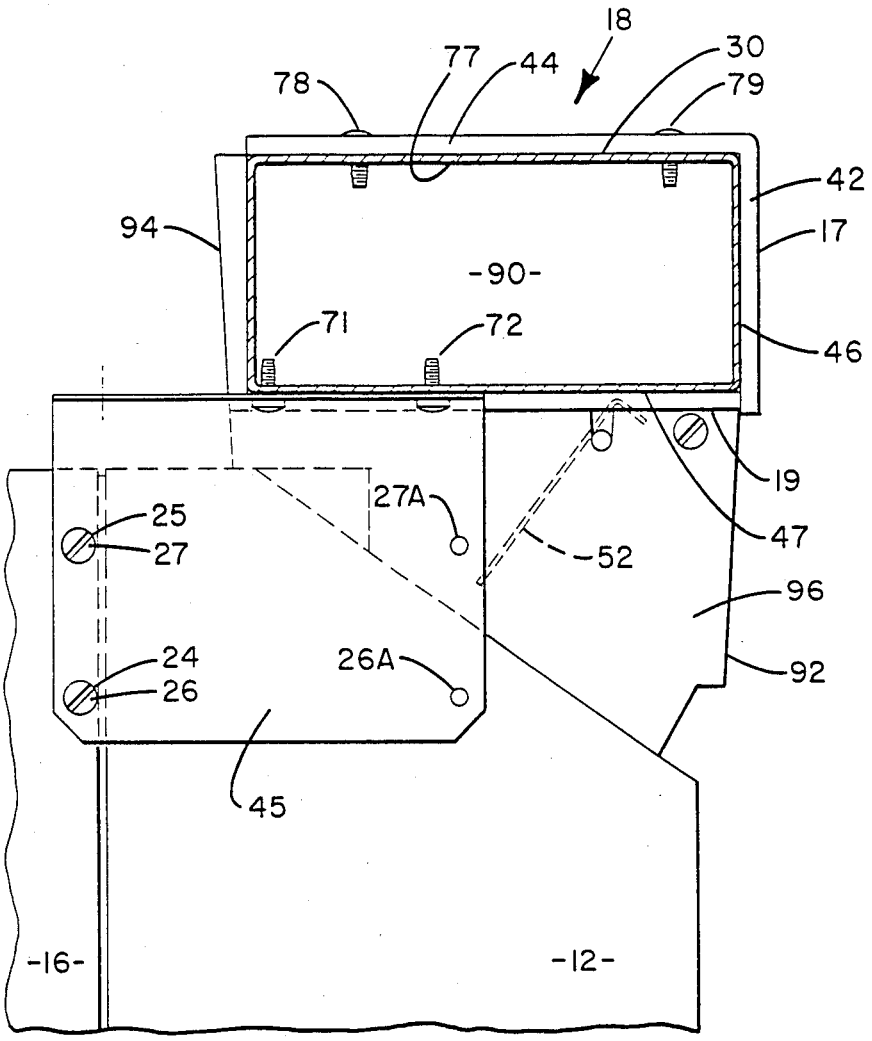
FIG. 3 is a partial side elevational view of the present invention looking from the left of FIG. 1.

Referring now to FIGS. 2 and 3, there is shown the chassis of a PTAC unit fastened to wall sleeve 16. Lower housing member 19 of duct adapter 18 is positioned over the chassis discharge opening such that air being discharged from the evaporator is discharged into the adapter and is diverted by a pivotal baffle 52 prior to being discharged into the spaces to be conditioned. Lower housing member 19 has a front wall 92, a rear wall 94, and two side walls 96. Upper housing member 17 has a front wall 42 and a top wall 44 secured to the front wall 92 and rear wall 94 respectively of the lower housing member 19 to form duct adapter 18 having an outlet 90 at the side of the duct adapter. The front wall 42 and top wall 44 of upper housing member 17 have longitudinally projecting flange-like portions 46 and 48 respectively, which in conjunction with longitudinally projecting flange 47 extending from the side wall 96 of the lower housing member 19, form a ring-like projecting C-flange open at the back end of the duct adapter.

Additionally shown is bracket 45, having an outwardly extending flange 43 along the upper edge thereof, fastened to wall sleeve 16 by fasteners 24 and 25 extending through apertures 26 and 27. If conditioned air were to be discharged to a room to the right of the unit, the bracket 45 would be fastened to the right side of the wall sleeve 16 by fasteners 24 and 25 extending through apertures 26A and 27A respectively.

As may be seen in FIG. 2 a collar portion 77 of extension 30 is adapted to be inserted into outlet 90 of the adapter and matingly engages with the longitudinally projecting flanges 46, 47, and 48. When assembled, the extension 30 is secured at one end to the wall of the adjoining room and near the opposite end to bracket 45 by fasteners 71 and 72 which are secured through apertures 36 and 37 on flange 43 (or 37 and 38 on flange 43 when the extension is moved to the right of the adapter), while duct adapter 18 is secured to extension 30 by fasteners 78 and 79. Accordingly, when it is necessary to remove the chassis from the sleeve, only fasteners 78 and 79 must be removed to allow the chassis to slide out of the sleeve while the extension stays fastened to the sleeve through brackets 45.

To install the duct extension 30, the bracket 45 is attached to wall sleeve 16, either on the right or left side of the sleeve depending on whether the extension is a right-hand extension or a left-hand extension. The chassis is then installed in the sleeve 16 and the lower housing member 19 positioned over the chassis discharge opening and secured thereto. An air baffle 52 is inserted into the lower housing member to direct air either to the room having the unit therein or to the adjacent room. Next, the duct extension 30, having discharge grille 32 extending into the adjacent room, is fastened to flange 43 of bracket 45 by fasteners 71 and 72. Finally, upper housing member 17 is secured to lower housing member 19, and also to extension 30 by fasteners 78 and 79, while end cap 15 is secured to the opposite end of duct adapter 18. Thus, to service the chassis, it is necessary to remove only fasteners 78 and 79 and slide the chassis out of sleeve 16 while the duct extension remains secured to sleeve 16 by way of bracket 45.

While this invention has been described with reference to the structure disclosed herein, it is not confined to the details set forth herein and this application is intended to cover any modifications or changes as may come within the scope of this invention.

What is claimed is:

1. An apparatus for attaching a fixed duct extension to the discharge opening of an air conditioning unit, the unit slidably inserted in and removed from a fixed through-the-wall sleeve, for supplying conditioned air to the space containing the unit and an adjacent space comprising:

a discharge plenum assembly adapted to be connected to the unit to encase the discharge opening, said discharge plenum assembly defining an air flow path for the conditioned air discharged from the unit and including a first housing member having a forward wall, a rear wall, and a pair of opposed side walls joining the front wall to said rear wall, and a second housing member having a top wall connected to a front wall, said top wall and said front wall fixedly attached to said rear wall and said forward wall respectively of said first housing member and forming a duct outlet in one of said side walls, said top wall and said front wall of said second housing member and one of said pair of opposed side walls of said lower housing member having longitudinal flanges extending therefrom forming a C-like flange;

a bracket removably secured to the through the wall sleeve having an outwardly extending flange member at the top of said bracket; and a duct extension means secured to said outwardly extending flange of said bracket near one end and to the wall of the adjacent space at the opposite end, said duct extension means having a collar at one end configured to engage with said C-like flange whereby said unit with said discharge plenum assembly attached thereto slidably engages with and disengages from the through-the-wall sleeve while said duct extension means is secured to said bracket.

2. The apparatus as set forth in claim 1 wherein said front wall of said first housing member includes a grille means defining an air discharge opening to discharge air into the space containing the unit.

3. The apparatus as set forth in claim 2 wherein said discharge plenum assembly includes two side walls, each side wall forming a duct opening therein and further comprising an end cap member fastened to the duct opening opposite the duct extension to prevent air from being discharged from one end of said discharge plenum assembly, whereby the duct extension and end cap member may be secured to either side wall such that conditioned air may be discharged through either side wall.

4. In combination a packaged terminal air conditioning unit slidably receivable in a through-the-wall sleeve, and a lateral duct extension matingly engaged with an adapter, for supplying conditioned air to a space containing the unit and an adjacent space, comprising:

a lower housing member secured to the unit having a forward wall, a rear wall, and two side walls joining the forward wall to said rear wall, one of said side walls having an outwardly, laterally projecting flange extending therefrom, an upper housing member secured to said lower housing member, said upper housing member having a top wall secured to said rear wall of said lower housing and a front wall extending from said top wall and secured to said forward wall of said lower housing member, said top wall and said front wall of said upper housing each having outwardly, laterally projecting flanges extending therefrom; and a planar bracket fastened to the through-the-wall sleeve, said bracket having an outwardly extending flange member at the top thereof whereby the lateral duct extension is fixedly secured to said flange member of said bracket, said lateral duct extension having a collar portion at the end of the lateral duct extension secured to said flange member of said bracket, said outwardly, laterally projecting flanges of said lower housing member and said upper housing member form a C-shaped flange for circumscribing part of said collar portion of the lateral duct extension.

5. The packaged terminal air conditioning unit as set forth in claim 4 wherein said front wall of said lower housing member includes a grille means defining an air discharge opening to discharge air into the space containing the unit.

6. A packaged terminal air conditioning unit as set forth in claim 5 further comprising an end cap member secured to the duct opening opposite the lateral duct extension to prevent air from being discharged therefrom.

* * * * *